US008967741B2

(12) United States Patent
Ferone

(10) Patent No.: US 8,967,741 B2
(45) Date of Patent: Mar. 3, 2015

(54) CEILING-MOUNTED SECURITY APPARATUS FOR FIREARMS

(71) Applicant: Adam T. Ferone, Anaheim, CA (US)

(72) Inventor: Adam T. Ferone, Anaheim, CA (US)

( * ) Notice: Subject to any disclaimer, the term of this patent is extended or adjusted under 35 U.S.C. 154(b) by 147 days.

(21) Appl. No.: 13/694,168

(22) Filed: Nov. 5, 2012

(65) Prior Publication Data

US 2014/0123567 A1 May 8, 2014

(51) Int. Cl.
*A47B 67/02* (2006.01)

(52) U.S. Cl.
USPC ..... 312/245; 312/321.5

(58) Field of Classification Search
USPC ..... 312/245–246, 248, 321.5, 326–328; 211/64; 206/317
See application file for complete search history.

(56) References Cited

U.S. PATENT DOCUMENTS

| | | | | | |
|---|---|---|---|---|---|
| 264,172 | A | | 9/1882 | Laskey | |
| 1,353,162 | A | | 9/1920 | James | |
| 1,652,987 | A | | 12/1927 | Meyercord | |
| 2,515,876 | A | * | 7/1950 | Kauffman | 312/241 |
| 2,915,192 | A | | 12/1959 | Roma, Jr. | |
| 3,369,721 | A | * | 2/1968 | Lentz | 206/317 |
| 3,464,606 | A | * | 9/1969 | Nordeen | 224/281 |
| 4,060,292 | A | | 11/1977 | Medina | |
| 5,056,342 | A | * | 10/1991 | Prinz | 70/63 |
| 5,078,279 | A | * | 1/1992 | Hancock et al. | 211/64 |
| 5,138,786 | A | * | 8/1992 | Fischer | 42/70.11 |
| 5,329,865 | A | | 7/1994 | McWard | |
| 5,475,949 | A | | 12/1995 | McCoy | |
| 5,664,727 | A | * | 9/1997 | Beall | 232/1 R |
| 5,683,021 | A | * | 11/1997 | Setina | 224/311 |
| 5,813,174 | A | | 9/1998 | Waller | |
| 7,246,865 | B1 | | 7/2007 | Merrell, II | |
| 7,513,580 | B2 | | 4/2009 | Merrell, II | |
| 8,136,897 | B2 | * | 3/2012 | Mascari | 312/242 |
| 2003/0159954 | A1 | * | 8/2003 | Russell | 206/317 |
| 2004/0140280 | A1 | * | 7/2004 | Cleveland et al. | 211/64 |
| 2005/0230334 | A1 | * | 10/2005 | MacDonald et al. | 211/64 |
| 2007/0277712 | A1 | | 12/2007 | Stepp | |
| 2008/0169739 | A1 | * | 7/2008 | Goldenberg | 312/244 |
| 2008/0252414 | A1 | * | 10/2008 | Crigger et al. | 340/5.52 |
| 2010/0259145 | A1 | * | 10/2010 | Martich et al. | 312/245 |
| 2011/0233085 | A1 | * | 9/2011 | Goldie | 206/317 |

* cited by examiner

*Primary Examiner* — Hanh V Tran
(74) *Attorney, Agent, or Firm* — Michael A. Painter

(57) ABSTRACT

A security apparatus for storing firearms adapted to be mounted within an enclosed area defined by a top wall, bottom wall, rear wall and one or more side walls. The security apparatus in the form of a lockable compartment secured to the ceiling of the enclosure adjacent the rear wall and consists of a rear panel and parallel spaced side panels secured to the rear wall and side walls, respectively. A bottom panel is hingedly coupled to the rear panel and adapted to be positioned adjacent the rear and side panels in opposition to the top wall of the enclosure. A front panel is pivotally coupled to the lower panel opposite the rear panel. Firearm retaining brackets are coupled to the interior surfaces of the front, lower and rear panels to secure the firearms.

7 Claims, 4 Drawing Sheets

CEILING-MOUNTED SECURITY APPARATUS FOR FIREARMS

BACKGROUND OF THE INVENTION

1. Field of the Invention

The present invention generally relates to a security apparatus for firearms adapted to be mounted to the undersurface of a structure and more particularly to those adapted to be mounted on the ceiling of an enclosure.

2. Prior Art

The present invention is intended to provide a security apparatus for safely storing firearms adjacent the ceiling of an enclosure such as a closet. One of the devices disclosed by the prior art comprises a security box assembly adapted to be secured to the undersurface of a table. A parallelogram linkage system consisting of pairs of parallel pivoted links are mounted on each side of the assembly to connect the side walls of the body portion of the side walls of the cover portion of the security assembly. When opened, the lowered body portion will be parallel to the undersurface. The problems inherent in this device stem from the inability to easily access the exposed surface of the body portion of the security assembly when it depends from the ceiling of an enclosure. The present invention resolves these problems by employing a hingedly coupled bottom and front walls that, when opened, provide visual contact with and access to firearms coupled to the surfaces thereof.

Another device taught by the prior art comprises a ceiling mounted storage box which is lowerable and retractable on guides attached to adjacent walls. The storage box can be raised or lowered by a rope positioned between the ceiling and the storage box. It is an objective of the present invention to make it appear to be coextensive with the ceiling of the closet, a feature that cannot be accomplished with the ceiling mounted storage box disclosed in the prior art. When the front and lower panels of the present invention are in the closed position, the viewable surfaces appear to be mere extensions of the side and top walls of the enclosure.

Security devices specifically to store firearms are disclosed by the prior art. One of the devices comprises a handgun safe that includes a tray to receive a handgun and a lid operatively associated with the tray such that the tray may slide horizontally with respect to the lid to selectively reveal or conceal the interior portion of the tray and the stored firearm. Inadequacies of this device are inherent in its purpose.

The present invention overcomes the inadequacies of the devices taught by the prior art. A closable compartment consisting of an upper and lower panel coupled to one another by a rear panel and opposing side panels is adapted to be mounted adjacent the ceiling of an enclosure such as a closet. The lower panel is hingedly coupled to the lower margin of the rear panel. A front panel which may be employed to obstruct entry to the interior of the present invention is hingedly coupled to the lower panel in opposition to the rear panel. In a closed position, the front panel extends between the upper and lower panel and the two side panels within which firearms can be securely maintained.

SUMMARY OF THE INVENTION

The present invention comprises a security enclosure adopted to be mounted within an enclosed area such as a closet in a manner that makes it appear to be an adjunct of the ceiling of the enclosure. The present invention security apparatus comprises a substantially rectangular enclosure formed by upper and lower spaced panels defining the uniform height of the enclosure. The upper panel is secured to the enclosure ceiling. Opposed side panels and a rear panel depend downwardly from the lateral and rear margins of the upper panel. A lower panel is hingedly secured to the rear panel in opposition to the upper panel, the lower panel being pivotable between a position adjacent the lower edges of the side panel to a position that is in a planar relationship with the rear panel. In its closed position, the lower panel can be detachably coupled to the opposed side panels.

To permit access to the interior of the security apparatus and the firearms maintained therein, a front panel is hingedly coupled to the front margin of the lower panel in opposition to the coupling between the lower and rear panels. Firearm retaining brackets may be coupled to the interior surfaces of the front, lower and/or rear panels for the purpose of securely positioning firearms when the front and/or lower panel are in the open position. When in a closed position, the front panel is secured to the top panel creating the illusion of a uniform enclosure ceiling.

It is an object of the present invention to provide an improved security apparatus for storing firearms.

It is another object of the present invention to provide a ceiling-mounted security apparatus for firearms.

It is yet another object of the present invention to provide a ceiling-mounted security apparatus that may be easily opened for access to stored firearms.

It is still another object of the present invention to provide a ceiling-mounted securing apparatus that can safely store firearms in the form of handguns and rifles.

It is still yet another object of the present invention to provide a ceiling-mounted security apparatus for firearms that is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
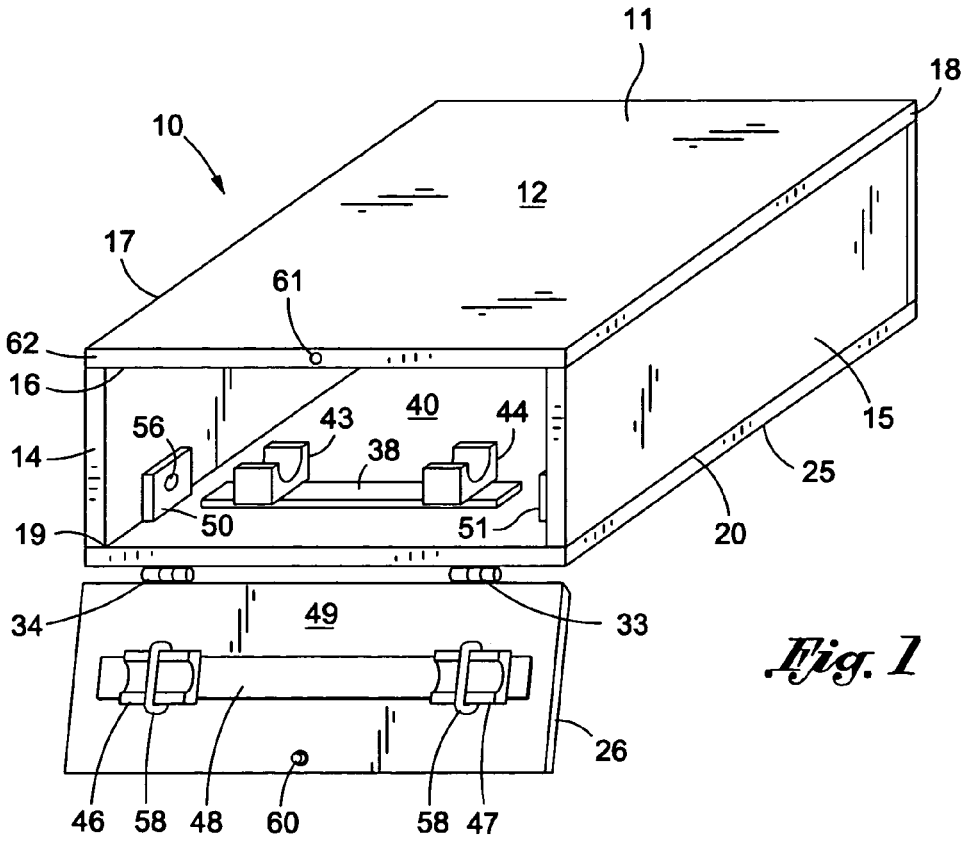
FIG. 1 is a perspective view of the present invention security apparatus illustrating an open front panel.
Figure 2:
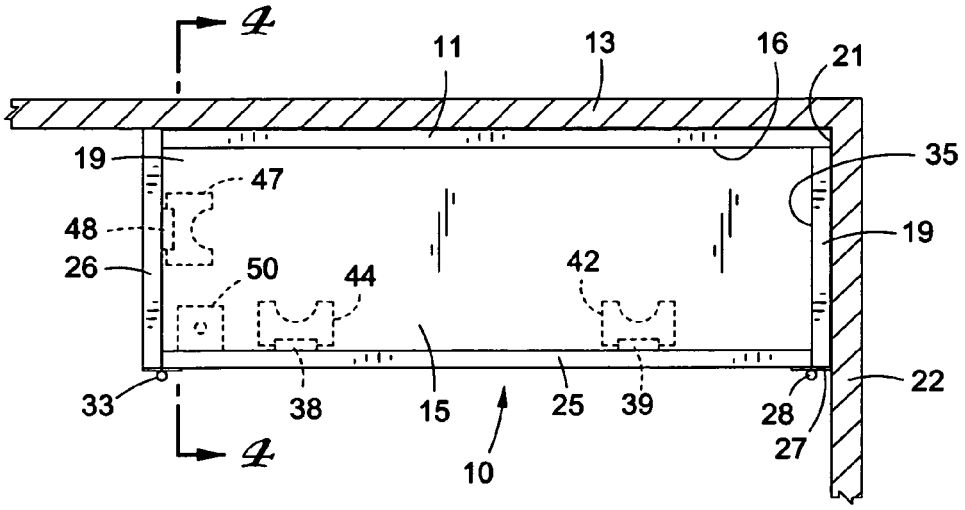
FIG. 2 is a side elevation of the present invention security apparatus mounted on the ceiling of an enclosure.

A primary objective of the present invention is to provide an apparatus in the form of a lockable secure compartment 10 for maintaining the security of firearms that can be mounted on the ceiling of a closet or other form of enclosed area. As can be best seen in FIG. 1 and FIG. 2, the present invention apparatus is in the form of lockable secure compartment 10 constructed of an upper panel 11 that is configured to the geometrical shape of the enclosure within which the present invention is to be mounted. For the purpose of example only, upper panel 11 is shown to be rectangular. As shown in FIG. 2, the upper surface 12 of upper panel 11 is secured to the ceiling 13 of the enclosed area.

Side panels 14 and 15 are secured to the bottom surface 16 of upper panel 11 at opposed margins 17 and 18 of upper panel 11. Side panels 14 and 15 are in parallel spaced relation to one another, the bottom edges thereof being equidistance from the bottom surface 16 of upper panel 11. Rear panel 19 is secured to bottom surface 16 of upper panel 11 adjacent the rear margin 20 of upper panel 11, rear panel 19 being positioned perpendicular to side panels 14 and 15. Rear panel 19 is adapted to be secured to surface 21 of the rear wall 22 of the enclosed area.

Figure 5:
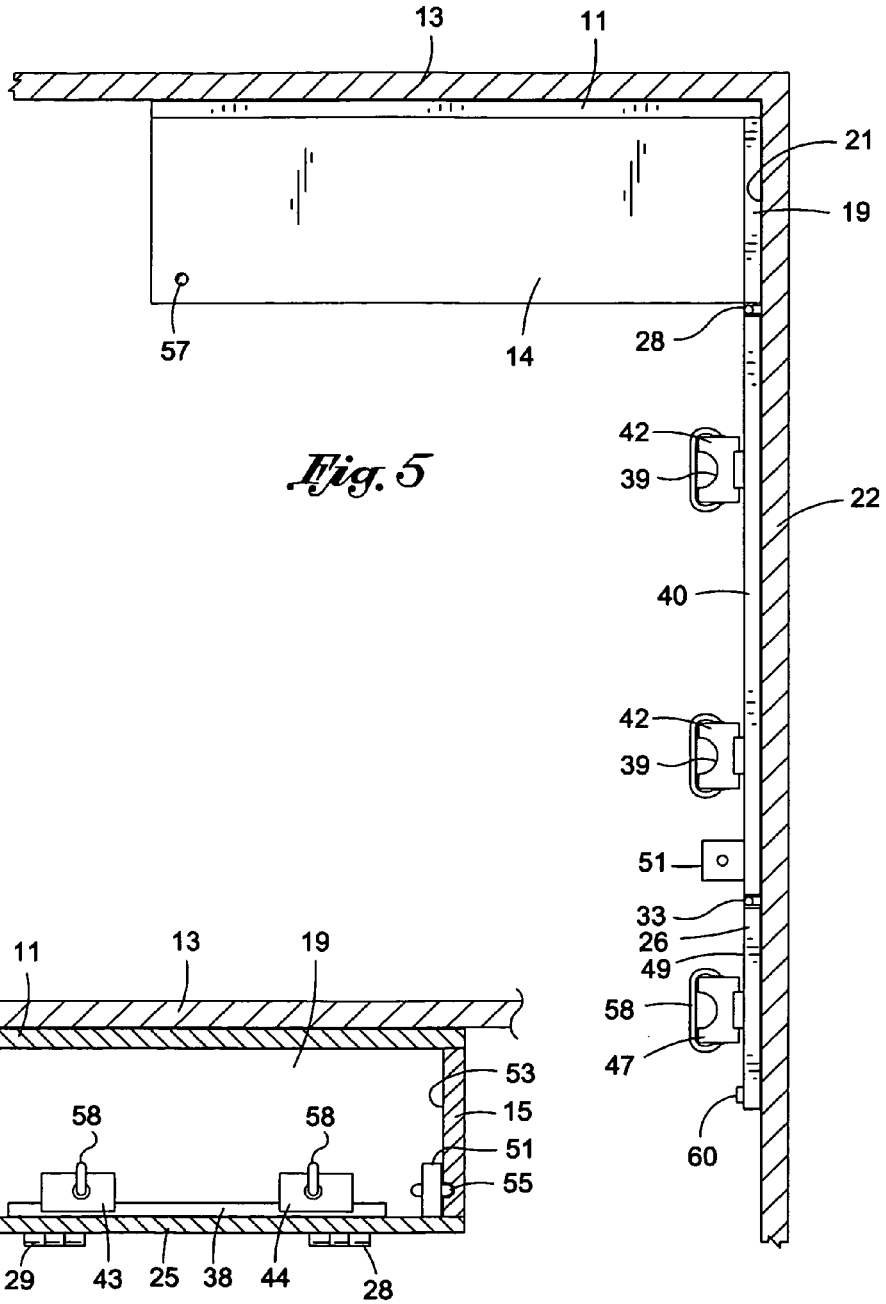
FIG. 5 is a side elevation view of the present invention security apparatus with the lower and front panels in the open position.

To provide access to the interior space of the present invention, secure compartment 10 includes a lower panel 25 and a front panel 26 that may be positioned to expose mounted firearm retaining clips in a manner described in detail hereinbelow. Lower panel 25 is pivotally coupled to the bottom margin 27 of rear panel 19 through the use of hinges 28 and 29. When lower panel 25 is in its closed position, it will be positioned adjacent the bottom edges 30 and 31 of side panels 14 and 15 respectively in parallel, spaced relation to upper panel 11. Front panel 26 is pivotally coupled to margin 32 through the use of hinges 33 and 34, respectively, mounted in opposition to hinges 28 and 29, respectively. FIG. 2 illustrates secure compartment 10 in its closed position which bars access to interior space 40. The open position of the present invention can be best seen in FIGS. 3 and 5. In the open position, lower panel 25 and front panel 26 are rotated counterclockwise from the position shown in FIG. 2 whereby rear panel 19, lower panel 25 and front panel 26 are in a coplanar relationship with one another adjacent rear wall 22.

Figure 6:
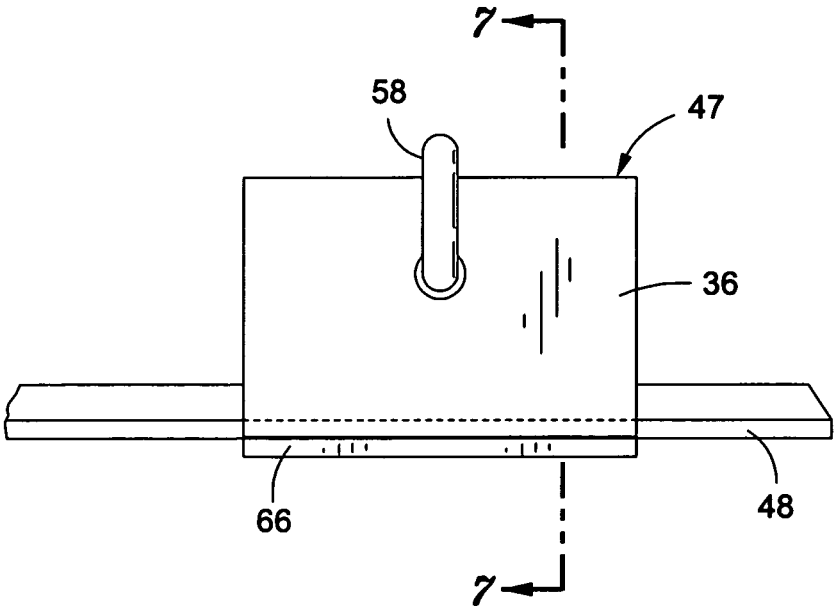
FIG. 6 is a side elevation view of a preferred form of a firearm retaining bracket to be employed with the present invention.
Figure 7:
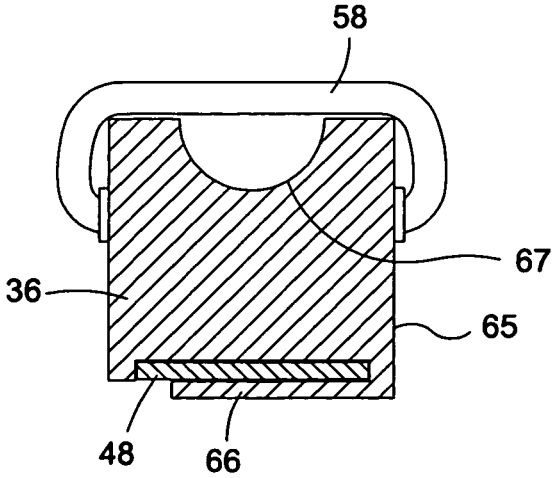
FIG. 7 is a cross-sectional view of the firearm retaining bracket shown in FIG. 6 taken through line 7-7 of FIG. 6.

The primary objective of the invention is to provide a secure compartment 10 within which firearms can be safely stored yet be accessible to the user. As can be best seen in FIG. 3, firearm retaining brackets 41-44 are coupled to the interior surface 40 of lower panel 25. In a like manner, firearm retaining brackets 46 and 47 are coupled to interior surface 49 of front panel 26. Using firearm retaining bracket 47 for the purpose of example, the preferred form for a firearm retaining bracket can be best seen in FIGS. 6 and 7. To couple firearm retaining brackets to the interior surfaces of lower and front panels 25 and 26, mounting strips 38 and 39 are secured to interior surface 40 in parallel spaced relation to each other and perpendicular side panels 14 and 15. In a like manner, mounting strip 48 is secured to interior surface 49 of front panel 26. As can be seen in FIGS. 6 and 7, firearm retaining bracket 47 consists of a substantially U-shaped receiving module 36. As best shown in FIG. 7, a lateral edge 65 of receiving module 36 is extended downwardly and inwardly into a gripping clip 66 that is adapted to impose force upon mounting strip 48 and thereby stabilize the position of firearm retaining bracket 47 at any desired position along mounting strip 48. It would be understood by those having skill in the art that all other firearm receiving brackets are coupled to the respective mounting strips in the same manner as shown in FIGS. 6 and 7. Although not shown, the present invention contemplates firearm retaining brackets in the form shown in FIGS. 6 and 7 to be secured to mounting strips affixed to interior surface 35 of rear wall 19.

Figure 3:
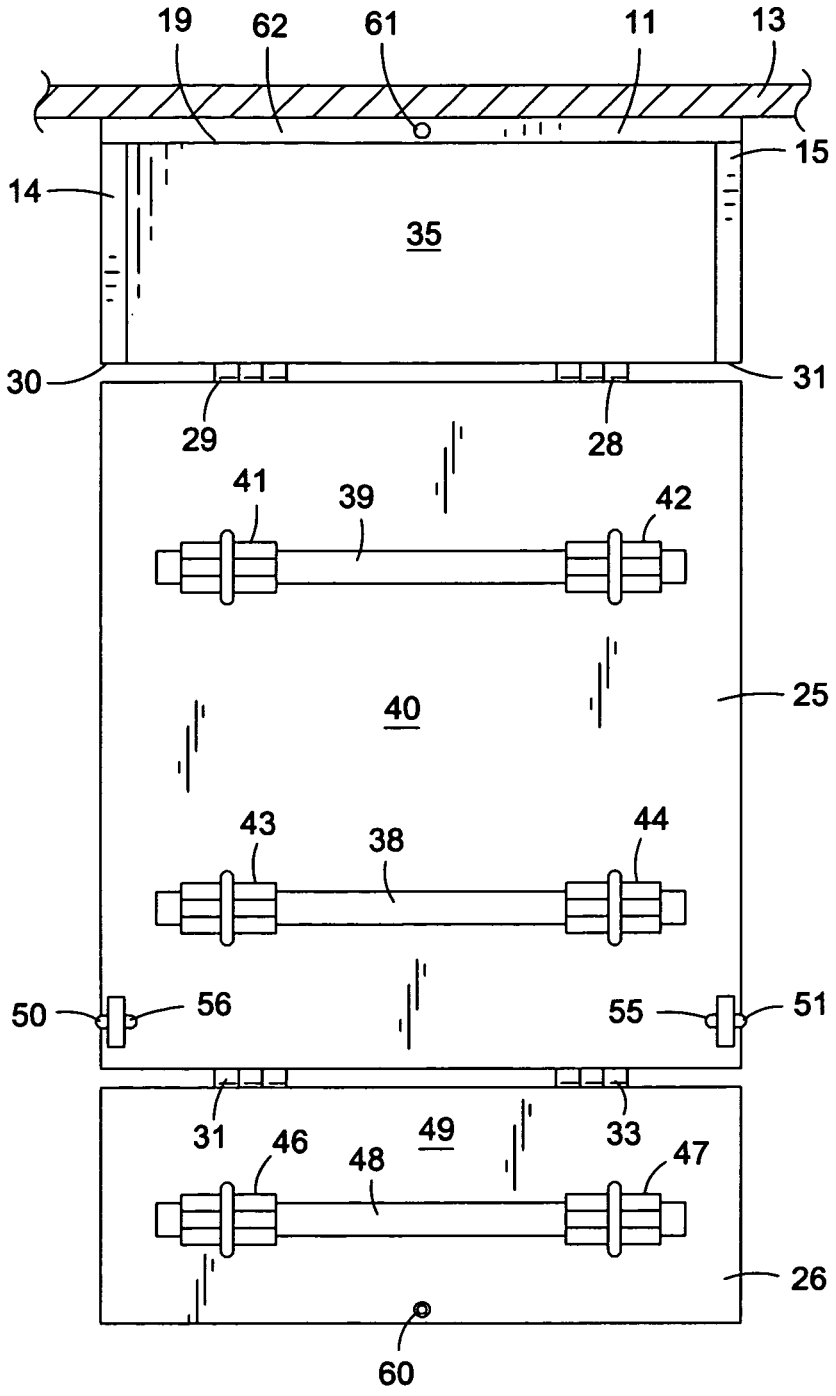
FIG. 3 is a front elevation view of the present invention illustrating open front and lower panels and firearm retaining brackets.

It is an object of the present invention for the present invention to be utilized to secure both rifles and handguns. As can be seen in FIGS. 3 and 7, a concave recess 67 is disposed in the top surface of receiving module 36 in parallel spaced relation to mounting strip 48. Concave recess 39 is adapted to accommodate the barrels of the firearms to be stored. Once a firearm is positioned in the concave recess 67 of all firearm retaining brackets then in use, a securing strap 58 is connected across concave recess 39 and thereby securely maintain the position of the firearms relative to the retaining brackets irrespective of whether lower panel 25 and front panel 26 are closed or are in the open position shown in FIG. 3.

Figure 4:
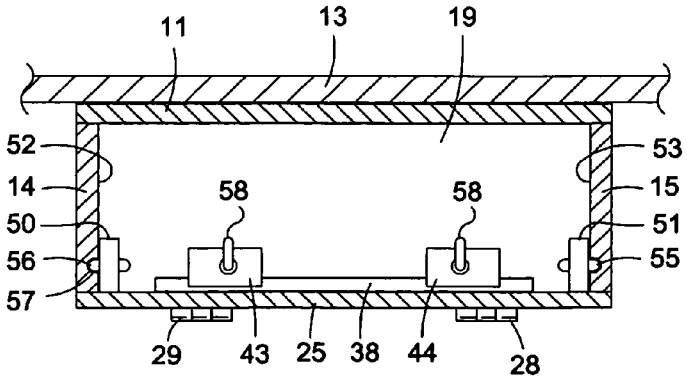
FIG. 4 is a partial, cross-sectional view of the present invention security apparatus taken through line 4-4 of FIG. 2.

It is an objective of the present invention to permit the present invention to be mounted adjacent the ceiling of an enclosed area and, when closed, the present invention will be disguised appearing to be part of the ceiling of the enclosed area. To accomplish this objective, lower panel 25 is adapted to be pivoted about hinges 28 and 29 until the opposed margins of interior surface 45 are positioned adjacent lower edges 30 and 31 of side panels 14 and 15, respectively (see FIGS. 3 and 4). To maintain lower panel 25 in its closed position adjacent lower edges 30 and 31, interior fasteners 50 and 51 are secured to interior surface 45 in a manner that will place them adjacent inner surfaces 52 and 53 of side panels 14 and 15, respectively, when lower panel 25 is rotated into its closed position. For the purpose of example only, interior fasteners 50 and 51 employ conventional sliding bolts 54 and 55 that are adapted to engage with detents 56 and 57, respectively, disposed into side panels 14 and 15. It would be understood by persons having skill in the art that the form of interior fasteners 50 and 51 can employ other conventional fasteners such as a hasp consisting of a hinged metal strap disposed over a staple and secured by a pin or padlock, the form of interior fasteners 50 and 51 being for the purpose of example only.

To prevent improper access to the interior of the compartment 10 and any firearms stored therein, a lock 59 is disposed through front panel 26, lock 59 employing a slidable shaft 60 adapted to lockingly engage detent 61 disposed into front edge 62 of top panel 11. It would be understood by persons having skill in the art that lock 59 can be implemented with a conventional key-accessible locking system.

The present invention substantially improves upon the structures taught by the prior art for securely storing firearms. Firstly, the present invention secure compartment 10 is adapted to be mounted to the ceiling of an enclosed area. Secondly, when secure compartment 10 is in its closed statement, it will be disguised to appear as part of the ceiling of the enclosed area. The present invention is designed to store both handguns and rifles. To gain access to the interior of the present invention, front panels 11 and 26 can be positioned to permit the user access to firearms mounted and secured to rear panel 19, lower panel 25 and front panel 26. Firearm restraining brackets 41, 42, 43, 44, 46 and 47 are coupled to the interior surfaces of lower panel 25, front panel 26 and rear panel 19. Through the use of mounting strips 38, 39 and 60 secured to the interior surfaces of panels 19, 25 and 26, firearm retaining brackets can be adjustably positioned by moving gripping clips 66 along the mounting strips to conform to the size of the firearm being stored within the present invention.

I claim:

1. A firearms security apparatus adapted to be mounted to the ceiling of an enclosure comprising:

(a) a planar top panel having top and bottom surfaces in parallel spaced relation to each other, secured to the ceiling of the enclosure;

(b) first and second planar side panels having interior and outer parallel surfaces and upper and lower edge margins, the upper edge of each of said first and second side panels being secured perpendicular to the bottom surface of the top panel, said side panels being in parallel spaced relation to one another;

(c) a planar rear panel having interior and outer parallel surfaces and upper and lower edge margins, the upper edge margin being secured to the lower surface of the top panel perpendicular to said first and second side panels;

(d) a planar lower panel having interior and outer surfaces and front and rear edge margins, the rear edge margin being pivotally coupled to the bottom edge margin of the rear panel and being adapted to be positioned adjacent the lower edge margins of said first and second side panels;

(e) a planar front panel having interior and outer surfaces and top and bottom edge margins, the bottom edge margin being pivotally coupled to the front edge margin of said lower panel and being adapted to be positioned adjacent the top panel and said first and second side panels;

(f) first and second locking means secured to the interior surface of the lower panel for detachably securing said lower panel to said first and second side panels, respectively;

(g) securing means disposed through said front panel for detachably securing said front panel to said top panel; and (h) firearm retaining means for maintaining the position of firearms coupled to the interior surface of at least one of said rear panel, lower panel or front panel, said firearm retaining means comprising:

(i) a plurality of rectangular, planar mounting strips disposed in parallel spaced relation to front and rear edge margins thereof and adapted to be perpendicular to the lower edge margins of said first and second side panels;

(ii) a plurality of U-shaped receiving modules having top, bottom and side surfaces and a uniform concave recess disposed in the top surface thereof in parallel spaced relation to the mounting strips and an opposed gripping clip extending from the bottom surface thereof adapted to be slidably engaged with a mounting strip; and (iii) a securing strap secured to the side surfaces of each U-shaped receiving module and extending across the concave recess of each receiving module whereby the firearms are securely maintained in a horizontal position when said lower and front panels are in the open position.

2. A firearms security apparatus as defined in claim 1 wherein said first and second locking means comprise slidable bolts disposed in parallel spaced relation to the interior surface of said lower panel, said sliding bolts being adapted to be received by detents disposed into the interior surfaces of said first and second side panels.

3. A firearms security apparatus as defined in claim 2 wherein the lower panel is in parallel spaced relation to the ceiling of the enclosure when said sliding bolts are received by the detents in said first and second side panels.

4. A firearms security apparatus as defined in claim 1 wherein said lower panel and said front panel are adapted to pivotally rotate downwardly and be coplanar with said rear panel.

5. A firearms security apparatus adapted to be mounted to the ceiling of an enclosure comprising:

(a) a planar top panel having top and bottom surfaces in parallel spaced relation to each other, secured to the ceiling of the enclosure;

(b) first and second planar side panels having interior and outer parallel surfaces and upper and lower edge margins, the upper edge of each of said first and second side panels being secured perpendicular to the bottom surface of the top panel, said side panels being in parallel spaced relation to one another;

(c) a planar rear panel having interior and outer parallel surfaces and upper and lower edge margins, the upper edge margin being secured to the lower surface of the top panel perpendicular to said first and second side panels;

(d) a planar lower panel having interior and outer surfaces in front and rear edge margins;

(e) a plurality of hinges secured between the rear edge margin of the lower panel and the lower edge margin of said rear panel whereby said lower panel will be positionable between being coplanar or perpendicular with said rear panel;

(f) a planar front panel having interior and outer surfaces and top and bottom margins;

(g) a plurality of hinges secured between the bottom edge margin of the front panel and the front edge margin of said lower panel whereby said front panel can be positioned between being coplanar with or perpendicular to the lower panel;

(h) first and second locking means secured to the interior surface of the lower panel for detachably securing said lower panel to said first and second side panels, respectively; and (i) securing means disposed through said front panel for detachably securing said front panel to said top panel;

(j) firearm retaining means for maintaining the position of firearms coupled to the interior surface of at least one of said rear panel, lower panel or front panel, said firearm retaining means comprising:

(i) a plurality of rectangular, planar mounting strips disposed in parallel spaced relation to front and rear edge margins thereof and adapted to be perpendicular to the lower edge margins of said first and second side panels;

(ii) a plurality of U-shaped receiving modules having top, bottom and side surfaces and a uniform concave recess disposed in the top surface thereof in parallel spaced relation to the mounting strips and an opposed gripping clip extending from the bottom surface thereof adapted to be slidably engaged with a mounting strip; and (iii) a securing strap secured to the side surfaces of each U-shaped receiving module and extending across the concave recess of each receiving module whereby the firearms are securely maintained in a horizontal position when said lower and front panels are in the open position.

6. A firearms security apparatus as defined in claim 5 wherein said first and second locking means comprise slidable bolts disposed in parallel spaced relation to the interior surface of said lower panel, said sliding bolts being adapted to be received by detents disposed into the interior surfaces of said first and second side panels.

7. A firearms security apparatus as defined in claim 5 wherein the lower panel is in parallel spaced relation to the ceiling of the enclosure when said sliding bolts are received by the detents in said first and second side panels.

* * * * *